US006637466B2

(12) United States Patent
Mills, Jr.

(10) Patent No.: US 6,637,466 B2
(45) Date of Patent: Oct. 28, 2003

(54) CLOSED-LOOP FILLING SYSTEM AND METHOD

(75) Inventor: Myron E. Mills, Jr., Roanoke, TX (US)

(73) Assignee: Lockheed Martin Corporation, Dallas, TX (US)

( * ) Notice: Subject to any disclaimer, the term of this patent is extended or adjusted under 35 U.S.C. 154(b) by 0 days.

(21) Appl. No.: 10/022,487

(22) Filed: Dec. 17, 2001

(65) Prior Publication Data

US 2003/0111129 A1 Jun. 19, 2003

(51) Int. Cl.[7] ..... B65B 1/04

(52) U.S. Cl. ..... 141/1; 141/59; 141/67; 141/286; 222/553

(58) Field of Search ..... 141/59, 67, 1, 141/2, 18, 301, 302, 286; 222/489, 479, 553, 521, 148; 417/313

(56) References Cited

U.S. PATENT DOCUMENTS 3,780,757 A * 12/1973 Jordan
4,915,597 A * 4/1990 Moore ..... 417/313
5,569,375 A * 10/1996 Ridgeway
5,848,622 A * 12/1998 Kilcoin

* cited by examiner

*Primary Examiner*—Steven O. Douglas
(74) *Attorney, Agent, or Firm*—Williams, Morgan & Amerson, P.C.

(57) ABSTRACT

A filling system includes a container, a cap for the container defining an egress and an ingress for a material from and to the container, respectively, a tank in fluid communication with the container through both the ingress and the egress of the cap, and means for urging the material between the container and the tank through the egress and ingress of the cap. A cap for a container includes a cap base engageable with the container and defining an inlet port and an outlet port, an inlet coupling in fluid communication with the inlet port, a draw tube, and an outlet coupling in fluid communication with the draw tube.

32 Claims, 3 Drawing Sheets

CLOSED-LOOP FILLING SYSTEM AND METHOD

BACKGROUND OF THE INVENTION

1. Field of the Invention

This invention relates to a method and apparatus for filling a device with a material.

2. Description of the Related Art

Many types of equipment require certain materials, such as fluids or the like, to perform their functions properly. For example, engines, heaters, and the like may require that fuel and processing equipment use certain chemicals to produce their intended product. Such materials may be flammable, damaging to surrounding equipment, harmful to the environment, or be otherwise hazardous to personnel transferring the materials. Accordingly, it may be desirable to avoid spilling such materials and to carefully contain the materials to inhibit harm to personnel, equipment, and the environment.

It may be critical for certain types of equipment to be continuously operated. For example, chemical processing equipment may require a continuous supply of feeder chemicals for, if the supply is stopped, the equipment may have to undergo time consuming and costly cleaning and restart procedures. Further, a portion of the product being produced may be unusable if one or all of the feeder chemicals are not continuously supplied, thus increasing the overall cost of producing the product. Accordingly, it may be desirable to provide a way of refilling tanks associated with such processing equipment so that the equipment may be continuously operated.

Some equipment may also have refilling ports that are in hard to reach locations. For example, an apparatus may have a refilling port that is within a housing, such that a portion of the material may be spilled as the material is poured into the refilling port. Or, an apparatus may be remotely located in a facility, in which case it may be difficult to carry a container containing material to the apparatus so that the apparatus may be replenished with the material. Thus, it may be desirable to provide a way for an apparatus to be replenished with material from a location some distance from the apparatus.

The present invention is directed to overcoming, or at least reducing, the effects of one or more of the problems set forth above.

SUMMARY OF THE INVENTION

In one aspect of the present invention, a filling system is presented. The filling system includes a container, a cap for the container defining an egress and an ingress for a material from and to the container, respectively, a tank in fluid communication with the container through both the ingress and the egress of the cap, and means for urging the material between the container and the tank through the egress and ingress of the cap.

In another aspect of the present invention, a cap for a container is presented. The cap includes a cap base engageable with the container and defining an inlet port and an outlet port, an inlet coupling in fluid communication with the inlet port, a draw tube, and an outlet coupling in fluid communication with the draw tube.

In yet another aspect of the present invention, a method is presented including engaging a cap with a container, coupling a first end of a conduit with the cap, coupling a second end of the conduit with the cap, and transferring material between the container and a tank through the conduit.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
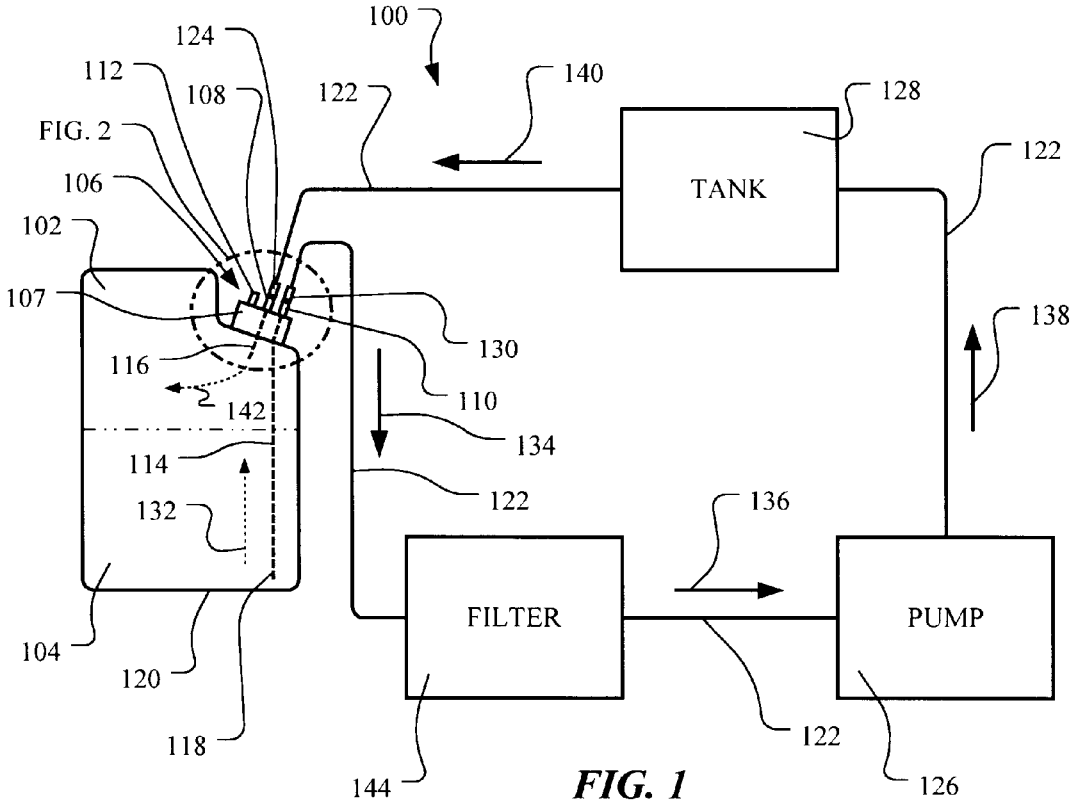
FIG. 1 is a stylized diagram of a filling system according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort, even if complex and time-consuming, would nevertheless be a routine undertaking for those of ordinary skill in the art having the benefit of this disclosure.

Figure 2:
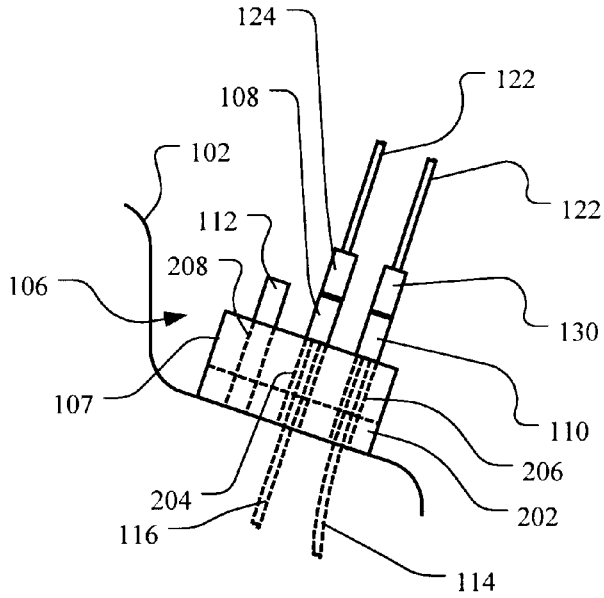
FIG. 2 is an enlarged view of a portion of the filling system illustrated in FIG. 1.

FIGS. 1 and 2 illustrate a filling system 100 according to the present invention. The filling system 100 includes a container 102 for storing a material 104. In one embodiment, the container 102 is a portable container, such as a jerry can or the like, although the present invention encompasses any desired configuration and/or size of the container 102. The filling system 100 further includes a cap 106 having a cap base 107 engaged with a spout 202 of the container 102, thus providing a means of engaging the cap 106 with the container 102. The cap 106 may alternatively be engaged with the spout 202 by any suitable means known to the art.

In the illustrated embodiment, the cap 106 defines an inlet port 204 extending therethrough and an outlet port 206 extending therethrough that provide fluid communication with the interior of the container 102. The inlet port 204 and outlet port 206 comprise an ingress and an egress for the material 104 from and to the container 102, respectively. An inlet coupling 108 may be attached to the cap 106 and communicate with the inlet port 204. Similarly, an outlet coupling 110 may be attached to the cap 106 and communicate with the outlet port 206.

In one embodiment, one or both of the inlet coupling 108 and the outlet coupling 110 may include valves (not shown) for inhibiting a flow of the material 104 therethrough. Thus, one or both of the inlet coupling 108 and the outlet coupling 110 may be capable of inhibiting the flow of the material 104 therethrough from within the container 102.

The cap 106 may further define an optional vent port 208 extending therethrough. In this embodiment, a vent 112 may be attached to the cap 106 such that it communicates with the vent port 208 to release gas, fumes, vapor, and/or the like that may have accumulated within the container 102. In one embodiment, the vent 112 may be capable of selectively releasing the gas, fumes, vapor, and/or the like that may have accumulated within and pressurized the container 102 if the pressure within the container 102 exceeds a predetermined amount.

Still referring to FIGS. 1 and 2, the illustrated embodiment includes a draw tube 114 extending from the outlet coupling 110, through the outlet port 206, and into the material 104, if present. Further, a return tube 116 extends from the inlet coupling 108, through the inlet port 206, and into the container 102. In one embodiment, a distal end 118 of the draw tube 114 is disposed proximate a floor 120 of the container 102. Note, however, that the draw tube 114 is not necessary to the practice of the invention.

The filling system 100 illustrated in FIGS. 1 and 2 further includes a conduit 122 serially extending from a first conduit coupling 124 to a pump 126, a tank 128, and a second conduit coupling 130. The combination of the inlet coupling 108 and the first conduit coupling 124, and the combination of the outlet coupling 110 and the second conduit coupling 130, provide a means of coupling the conduit 122 with the cap 106. The pump 126 draws the material 104 from the container 102 via the draw tube 114, the outlet coupling 110, the second conduit coupling 130, and the conduit 122 (as indicated by arrows 132, 134, 136, 138) and forces the material 104 into the tank 128 via the conduit 122. Accordingly, the pump 126 provides a means of transferring the material 104 between the container 102 and the tank 128. The material 104 may be pumped into the tank 128 in this manner to the desired level.

Thus, the container 102, the pump 126, and the tank 128 are in fluid communication with one another. Further, the fluid communication between the container 102, the pump 126, and the tank 128 is sealed, except for allowing pressure within the container 102 to escape via the vent port 208 and the vent 112.

Any excess material 104 displaced from the tank 128 due to the forcing of the material 104 therein by the pump 126 from the container 102 is returned to the container 102 via the conduit 122, the first conduit coupling 124, the inlet coupling 108, and the return tube 116 (as indicated by arrows 140, 142). This excess return consequently prevents spillage from overfilling the tank 128 in a controlled fashion without contaminating the excess material 104 or the environment. Further, in one embodiment, the pump 126 may be operated in an alternate fashion to drain the material 104 from the tank 128 into the container 102 by causing the material 104 to flow in a direction opposite to that indicated by the arrows 132, 134, 136, 138 through the conduit 122.

Thus, the filling system 100 may be used to transfer the material 104 from the container 102 to the tank 128. Further, the filling system 100 may be used to purge contents of the tank 128, by pumping the material 104 through the tank 128 for a period of time, supplying new material 104, and repeating the pumping of the material 104 through the tank 128.

In the illustrated embodiment, the filling system 100 further includes a filter 144 disposed in series with the conduit 122 such that the material 104, as it is being pumped by the pump 126, enters the filter 144 from and is transmitted therefrom to the conduit 122. The filter 144 may be capable of removing any undesirable material, such as debris, undesired chemicals, undesired gases entrained in the material 104, or the like.

Figure 3:
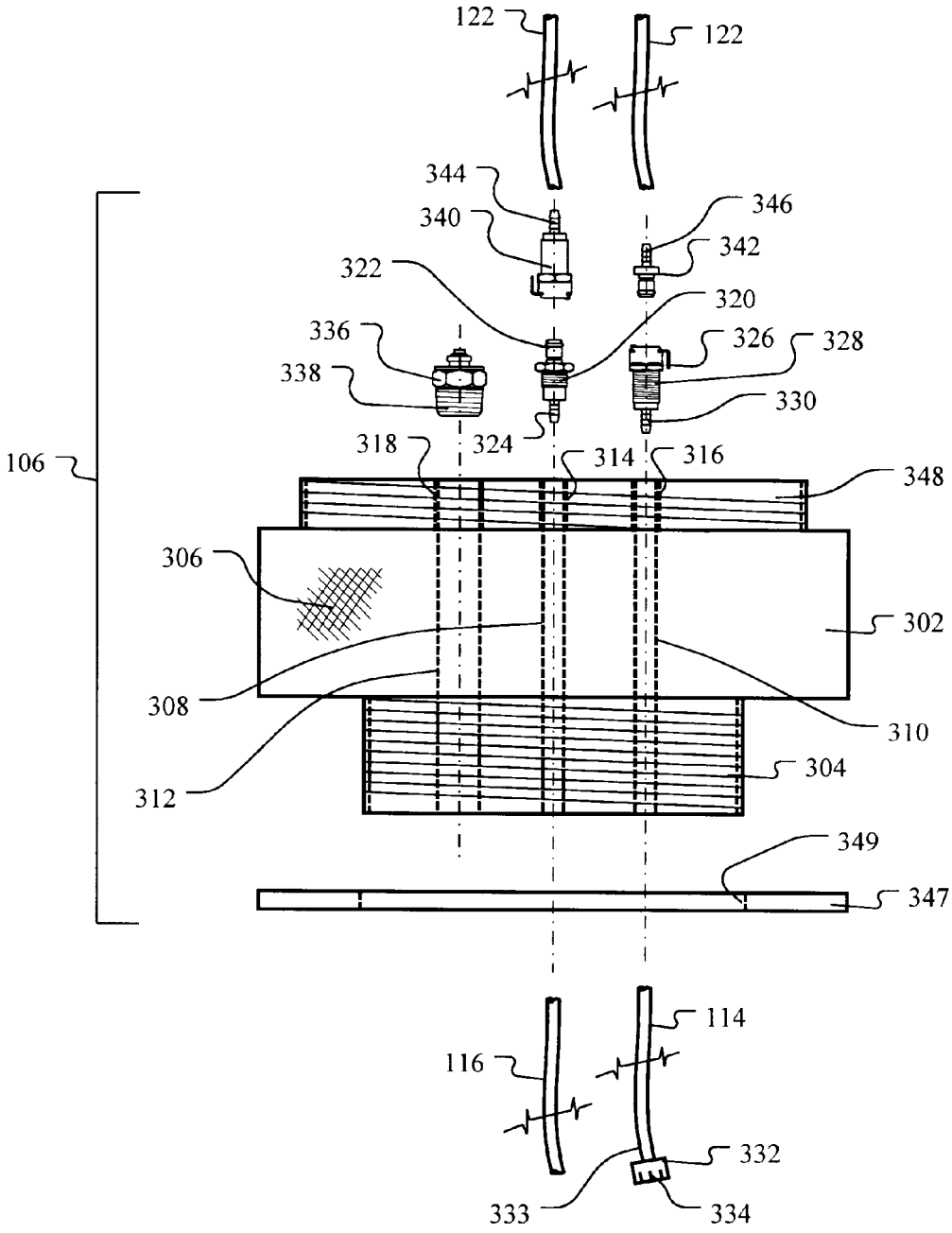
FIG. 3 is an exploded, plan view of an embodiment of a cap according to the present invention.

FIG. 3 illustrates an embodiment of the cap 106 according to the present invention in an exploded, plan, side view. The cap 106 includes a cap base 302 that may be made from a non-sparking material, such as aluminum, brass, a polymeric material, or the like. In the illustrated embodiment, the cap base 302 further includes a first threaded portion 304 that is threadedly engageable with a container, such as the container 102 of FIG. 1. The cap base 302 may have a knurled portion 306 (only a portion thereof is illustrated) to aid a user in engaging and disengaging the cap base 302 with the container. The cap base 302 defines three ports therethrough: an inlet port 308, an outlet port 310, and a vent port 312, each of which are in fluid communication with an interior of the container when the cap base 302 is engaged with the container.

In the illustrated embodiment, each of the inlet port 308, the outlet port 310, and the vent port 312 have threaded portions 314, 316, 318, respectively. A threaded portion 320 of an inlet coupling 322 is threadedly engageable with the threaded portion 314 of the inlet port 308. In one embodiment, the inlet coupling 322 is a model MCD4202 coupling insert, manufactured by Colder Products Company of St. Paul, Minn., which has a shutoff valve (not shown) for selectively inhibiting a flow of material therethrough. The inlet coupling 322 may alternatively be a model MC4202 coupling insert, also manufactured by Colder Products Company, which omits the shutoff valve therein. The inlet coupling 322 further includes a hose barb 324 for engaging the return tube 116.

The cap 106 further includes an outlet coupling 326 having a threaded portion 328 that is threadedly engageable with the threaded portion 316 of the outlet port 310. In one embodiment, the outlet coupling 326 is a model MCD1602 coupling body, also manufactured by Colder Products Company, which has a shutoff valve (not shown) for selectively inhibiting a flow of material therethrough. The outlet coupling 326 may alternatively be a model MC1602 coupling body, also manufactured by Colder Products Company, which omits the shutoff valve therein. The outlet coupling 326 further includes a hose barb 330 for engaging the draw tube 114.

In the illustrated embodiment, a fitting 332 engaged with a distal end 334 of the draw tube 114 to provide weight to the draw tube 114 such that the material may be drawn from a volume near the bottom of the container. The fitting 332 may have one or more slots 334 (only one indicated) to inhibit the formation of a vacuum seal between the fitting and a floor of the container (e.g., the floor 120 of the container 102, illustrated in FIG. 1, or the like). The fitting 332 may also be capable of filtering the material as it passes through the fitting 332.

Still referring to FIG. 3, the illustrated embodiment of the cap 106 further includes a vent 336 having a threaded portion 338 for threadedly engaging the threaded portion 318 of the vent port 312. In one embodiment, the vent 336 is a pressure relief vent, such as a PRV-type relief vent manufactured by Lube Devices, Inc. of Manitowoc, Wis. Thus, the vent 336 is capable of venting built-up pressure within the container that exceeds a predetermined pressure.

The cap 106 further comprises a first conduit coupling 340 that is capable of mating with the inlet coupling 322 and a second conduit coupling 342 that is capable of mating with the outlet coupling 326. In the illustrated embodiment, each of the first conduit coupling 340 and the second conduit coupling 342 have a hose barb 344, 346, respectively, for engaging ends of the conduit 122. In one embodiment, the first conduit coupling 340 is a model MCD1702 coupling body, manufactured by Colder Products Company, which has a shutoff valve (not shown) for selectively inhibiting a flow of material therethrough. The first conduit coupling 340 may alternatively be a model MC1702 coupling body, also manufactured by Colder Products Company, which omits the shutoff valve therein. Further, the second conduit coupling 342 may be a model MCD2202 coupling body, manufactured by Colder Products Company, which has a shutoff valve (not shown) for selectively inhibiting a flow of material therethrough. The second conduit coupling 342 may alternatively be a model MC2202 coupling body, also manufactured by Colder Products Company, which omits the shutoff valve therein.

While the embodiment illustrated in FIG. 3 has been described as having certain vent and couplings, the present invention encompasses any style vent and couplings desired. Further, the present invention encompasses a cap that omits a vent, such as the vent 336, and omits a vent port, such as the vent port 312.

In the embodiment illustrated in FIG. 3, the cap 106 further includes a gasket 347, which may be disposed between the cap base 302 and the container to sealably engage the cap base 302 to the container. The gasket 347 defines an opening 349 therethrough, such that the threaded portion 304 of the cap base 302 may be disposed through the opening 349 and engaged with the container.

Figure 4:
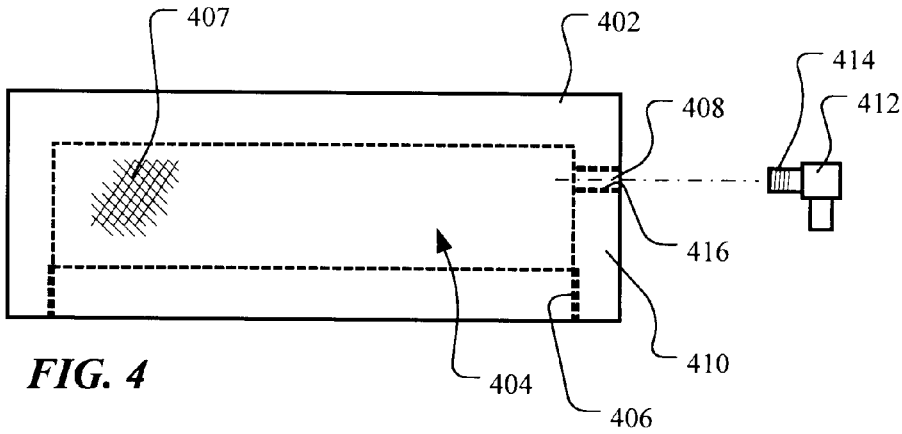
FIG. 4 is an exploded, plan view of an embodiment of a cap cover according to the present invention.

The cap base 302 further includes a threaded portion 348 for threadably engaging with a cap cover 402, illustrated in FIG. 4. The cap cover 402 defines a cavity 404 therein and has a threaded portion 406 that is threadably engageable with the threaded portion 348 of the cap base 302 (shown in FIG. 3). Thus, when engaged with the cap base 302, the cap cover 402 covers and protects the couplings 322, 326 of the cap 106 from inadvertent damage and debris accumulation. The cap cover 402 may have a knurled portion 407 to aid a user in engaging and disengaging the cap cover 402 with the cap base 302.

The cap cover 402 further defines a vent 408 through a sidewall 410 thereof such that, as gases and/or vapors are released from the interior of the container (not shown) by the vent 336 (shown in FIG. 3), the gases and/or vapors may escape into the atmosphere. In the illustrated embodiment, an elbow fitting 412 having a threaded portion 414 is threadably engaged with a threaded portion 416 of the vent 408 through the sidewall 410 of the cap cover 402 so that the released gases and/or vapors may be directed away from a user. In one embodiment, the cap cover 402 is made from a non-sparking material, such as aluminum, brass, a polymeric material, or the like, which may or may not comprise the same material as the cap base 302 (shown in FIG. 3).

Figure 5:
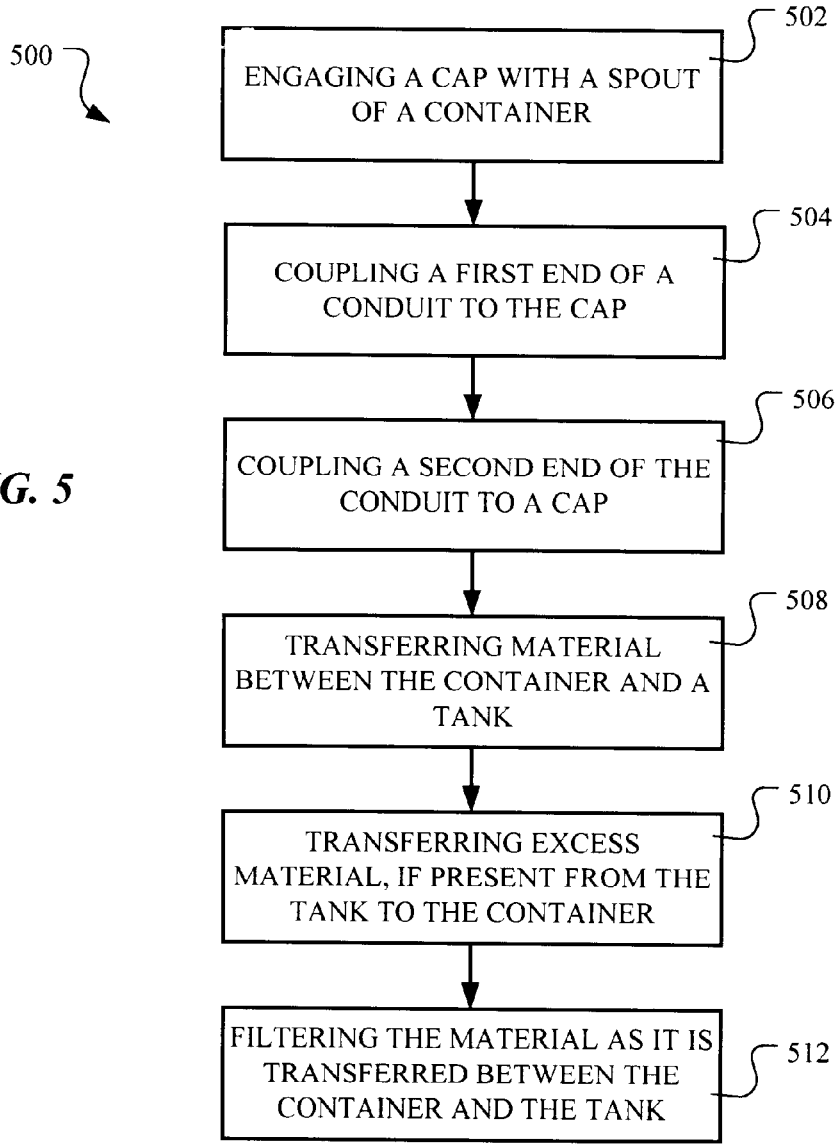
FIG. 5 is a flowchart of a method according to the present invention.

A method 500 according to the present invention is illustrated in FIG. 5. The method includes engaging a cap with a spout of a container (block 502) and coupling a first end of a conduit to the cap (block 504). The method further includes coupling a second end of the conduit to the cap (block 506) and transferring material between the container and a tank (block 508). The tank may be filled with the material from the container, or the material may be drained from the tank to the container. In one embodiment, the method further includes transferring excess material from the tank to the container (block 510). In another embodiment, the method further includes filtering the material as it is transferred between the container and the tank (block 512).

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A filling system, comprising:

a container;

a cap for the container defining an egress and an ingress for a material from and to the container, respectively;

a tank in fluid communication with the container through both the ingress and the egress of the cap; and means for urging the material between the container and the tank through the egress and ingress of the cap.

2. A filling system, according to claim 1, wherein the means for urging the material between the container and the tank further comprises a pump.

3. A filling system, according to claim 1, wherein the container further comprises a portable container.

4. A filling system, according to claim 1, further comprising a filter in fluid communication between the container and the tank.

5. A filling system, according to claim 1, wherein the cap further comprises a cap base defining a vent port for releasing pressure from the container.

6. A filling system, according to claim 5, wherein the cap further comprises a vent in fluid communication with the vent port for controllably releasing pressure from the container.

7. A filling system, according to claim 1, wherein the cap further comprises a cap base defining an ingress and an egress and the cap further comprises:

an inlet coupling in fluid communication with the ingress;

a draw tube extending into the egress and having a distal end in contact with the material in the container; and an outlet coupling in fluid communication with the draw tube.

8. A filling system, according to claim 7, wherein at least one of the inlet coupling and the outlet coupling is capable of inhibiting a flow of the material therethrough.

9. A filling system, according to claim 7, further comprising a fitting mounted to the distal end of the draw tube and being capable of inhibiting a formation of a vacuum seal between the fitting and an interior surface of the container.

10. A filling system, according to claim 7, further comprising a return tube in fluid communication with the inlet coupling.

11. A cap for a container, comprising:

a cap base engageable with the container and defining an inlet port, an outlet port, and a vent port;

an inlet coupling in fluid communication with the inlet port;

a draw tube; and an outlet coupling in fluid communication with the draw tube.

12. A cap, according to claim 11, wherein the cap base further defines a vent port for releasing pressure from the container.

13. A cap, according to claim 11, wherein the cap base further defines a vent port and the cap further comprises a vent in fluid communication with the vent port for controllably releasing pressure from the container.

14. A cap, according to claim 11, further comprising a cap cover engageable with the cap base and defining a vent port therethrough for releasing pressure within the cap cover when the cap cover is engaged with the cap base.

15. A method, comprising:

engaging a cap with a container;

coupling a first end of a conduit with the cap;

coupling a second end of the conduit with the cap; and transferring material between the container and a tank through the conduit.

16. A method, according to claim 15, wherein transferring material between the container and the tank includes transferring excess material from the tank to the container.

17. A method, according to claim 15, wherein transferring material between the container and the tank includes filling the tank with material from the container.

18. A method, according to claim 15, wherein transferring material between the container and the tank includes draining the material from the tank to the container.

19. A method, according to claim 15, further comprising filtering the material as it is transferred between the container and the tank.

20. An apparatus, comprising:

means for engaging a cap with a container;

means for coupling a first end of a conduit with the cap;

means for coupling a second end of the conduit with the cap; and means for transferring material between the container and a tank through the conduit.

21. An apparatus, according to claim 20, wherein the means for transferring material between the container and the tank includes means for transferring excess material from the tank to the container.

22. An apparatus, according to claim 20, wherein the means for transferring material between the container and the tank includes means for filling the tank with material from the container.

23. An apparatus, according to claim 20, wherein the means for transferring material between the container and the tank includes means for draining the material from the tank to the container.

24. An apparatus, according to claim 20, further comprising means for filtering the material as it is transferred between the container and the tank.

25. An apparatus, comprising:

means for storing a material;

means for transmitting the material from the means for storing the material to a device and from the device to the means for storing the material; and means for releasably coupling the means for transmitting the material with the means for storing the material.

26. An apparatus, according to claim 25, wherein the means for storing the material further comprises a container.

27. An apparatus, according to claim 25, wherein the means for transmitting the material further comprises a conduit in fluid communication with the means for storing the material.

28. An apparatus, according to claim 25, wherein the means for transmitting the material further comprises:

a conduit in fluid communication with the means for storing the material; and a pump in fluid communication with the conduit capable of urging the material through the conduit between the means for storing the material and the device.

29. An apparatus, according to claim 25, wherein the means for releasably coupling further comprises:

a cap base capable of being engaged with the means for storing the material; and a releasable coupling mounted to the cap base and being in fluid communication with the means for storing the material and the means for transmitting the material.

30. An apparatus for coupling a container with a conduit, comprising:

means for capping the container; and means for releasably coupling the means for capping the container and the conduit, the means for releasably coupling being capable of inhibiting a flow of fluid through the conduit when the means for capping the container and the conduit are uncoupled.

31. An apparatus, according to claim 30, wherein the means for capping the container further comprises a cap base capable of being engaged with the container.

32. An apparatus, according to claim 30, wherein the means for releasably coupling further comprises a releasable coupling mounted to the cap base and being in fluid communication with the container and the conduit.

* * * * *